United States Patent [19]

Ghassemi et al.

[11] Patent Number: 4,610,301

[45] Date of Patent: Sep. 9, 1986

[54] INFILL DRILLING PATTERN

[75] Inventors: Farhad Ghassemi, Lafayette, La.; John D. Alexander, Ponca City, Okla.

[73] Assignee: Conoco Inc., Ponca City, Okla.

[21] Appl. No.: 781,574

[22] Filed: Sep. 30, 1985

[51] Int. Cl.[4] ..... E21B 43/24; E21B 43/30

[52] U.S. Cl. ..... 166/245; 166/263; 166/272

[58] Field of Search ..... 166/245, 263, 268, 272

[56] References Cited

U.S. PATENT DOCUMENTS

| | | | |
|---|---|---|---|
| 2,885,002 | 5/1959 | Jenks | 166/245 |
| 3,393,735 | 7/1968 | Altamira et al. | 166/245 |
| 3,402,768 | 9/1968 | Felsenthal et al. | 166/245 |
| 3,476,182 | 11/1969 | Allen | 166/245 |
| 3,593,787 | 7/1971 | Hoyt | 166/245 |
| 3,805,892 | 4/1974 | Haynes, Jr. | 166/245 |
| 3,874,449 | 4/1975 | Hoyt et al. | 166/263 X |
| 3,946,808 | 3/1976 | Bousaid et al. | 166/245 |
| 4,082,358 | 4/1978 | Learmont | 166/245 X |
| 4,166,501 | 9/1979 | Korstad et al. | 166/263 |
| 4,166,502 | 9/1979 | Hall et al. | 166/263 |
| 4,166,503 | 9/1979 | Hall et al. | 166/263 |
| 4,166,504 | 9/1979 | Brown et al. | 166/263 X |
| 4,177,752 | 12/1979 | Brown et al. | 166/263 |
| 4,321,966 | 3/1982 | Traverse et al. | 166/245 |
| 4,325,432 | 4/1982 | Henry | 166/245 |
| 4,366,863 | 1/1983 | Frick et al. | 166/245 |
| 4,487,260 | 12/1984 | Pittman et al. | 166/245 X |

*Primary Examiner*—George A. Suchfield

*Attorney, Agent, or Firm*—A. Joe Reinert

[57] ABSTRACT

A method is provided for modifying an original distribution pattern including an original central injection well and four original corner production wells. One or more new injection wells are provided at locations approximately aligned midway between adjacent ones of the original corner production wells. In addition to the two original corner production wells between which it is located, there are associated with each new injection well four additional new production wells. A first pair of these new production wells is provided at locations substantially aligned between and preferably substantially midway between the original central injection well and the two adjacent ones of the original corner production wells. A second pair of new production wells is located substantially as a mirror image of the first pair about an imaginary straight line between the two adjacent ones of the original corner production wells. This forms a new seven-spot pattern having its new injection well located substantially in the center of an area which was relatively unaffected by the original fluid distribution pattern.

32 Claims, 5 Drawing Figures

INFILL DRILLING PATTERN

BACKGROUND OF THE INVENTION

1. Field Of The Invention

This invention relates to a process for enhancing the recovery of oil from a subterranean oil-bearing formation and particularly to a process for controlling the distribution of a displacing fluid such as injected steam or water in order to sweep the areas of high oil saturation which remain in the formation after a conventional five-spot or nine-spot flooding pattern has been employed.

2. Description Of The Prior Art

In the primary stage of oil production from a subterranean oil formation, there is usually sufficient pressure to force the oil to at least the bottom of the well bore so that it can be produced or pumped out. The primary production period ends when the pressure is no longer sufficient to displace the oil from the reservoir. Due to the fact that a relatively large portion of the total oil still remains in the formation at this point, a number of enhanced oil recovery techniques have been developed.

Flooding the formation with either water or steam is a secondary recovery or enhanced oil recovery technique. The steam or water is injected into the formation through various injection wells to drive the remaining oil towards certain production wells. When an oil field is first developed for flooding, the various injection wells and production wells are spaced in a large pattern. Two common patterns are five-spot patterns and nine-spot patterns.

If a five-spot pattern is employed, typically one central injection well is initially drilled for every twenty, forty or even eighty acres. A corner production well is placed in each corner of each individual acreage, with the four corner production wells defining a substantially square boundary of the five-spot pattern. The well spacing is initially large due to the high cost of drilling the wells and uncertainties about the exact boundaries of the reservoir.

When a driving fluid such as steam or water is injected into the formation through the central injection wells, it spreads throughout the reservoir displacing the oil before it. As the fluid-oil interface moves toward a producing well, the fluid often fingers, overcomes the bank of oil and breaks through to the producing well. This results in only a partial sweeping of the oil reservoir.

In order to increase the sweep efficiency of the flooding operation, a typical five-spot pattern is often later converted into four smaller five-spot patterns so that the spacing between injection and production wells is decreased to aid in sweeping areas of the formation which have not previously been adequately swept. For example, if the initial five-spot pattern is on a twenty-acre tract, four five-acre, five-spot patterns can be created.

Unfortunately, these typical prior art techniques of reducing an initial five-spot pattern into four smaller five-spot patterns are only partially successful in increasing the sweep efficiency of the flooding operation.

This is because the typical prior art methods place new injection wells between the central injection well and the corner production wells of the original five-spot patterns. As a result, much of the fluid injected into the new injection wells follows the less resistive paths or channels that were established by the first flooding operation. Thus, many of the areas of high oil saturation that remain after the first flooding operation are still not reached.

Due to the great cost of any enhanced oil recovery process, there is a need for a technique or pattern that will increase the overall sweep efficiency of the flooding operations.

SUMMARY OF THE INVENTION

The present invention provides a method of modifying an original fluid distribution pattern for injecting driving fluid into a subsurface formation. The original pattern includes a plurality of contiguous original pattern units, each including an original central injection well and four original corner production wells substantially defining the corners of an imaginary square. This original pattern unit may be either a five-spot or a nine-spot pattern unit.

Contiguous ones of the pattern units share two common ones of the original corner production wells.

The method of modifying this original distribution pattern includes several steps.

A plurality of new injection wells are provided, each of said new injection wells being located in an approximately aligned position between adjacent ones of the original corner production wells. Preferably, the new injection wells are located substantially midway between these two adjacent corner production wells.

Also, a plurality of new production wells are provided. Each new production well is located in an approximately aligned position between one of the original central injection wells and an associated one of the original corner production wells. The new production wells are preferably located substantially midway between the original central injection well and the associated original corner production well.

The new injection wells and new production wells are so arranged that each of the new injection wells is surrounded by two adjacent ones of the original corner production wells and four of the new production wells defining a new seven-spot pattern unit.

The overall fluid distribution pattern in a field originally made up of a number of original pattern units as defined, and subsequently modified according to the present invention, will include a plurality of contiguous seven-spot pattern units.

Around each original central injection well there will be a substantially square area which is surrounded by but not included in four contiguous ones of the new seven-spot pattern units.

Driving fluid is injected into the new injection wells. These new injection wells are located in the center of those areas of the formation which are typically least effected by the original fluid distribution pattern of the original five-spot or nine-spot pattern unit.

This driving fluid will sweep to the six surrounding production wells and drive much of the remaining oil to those wells to be produced.

If necessary, the original central injection wells can be used as back-up injection wells to confine fluid flow within the new seven-spot pattern units. Otherwise, the original central injection wells are shut in.

From the foregoing description of the present invention, it will be apparent that an important object of the invention is to provide an infill drilling pattern that increases the efficiency of the flooding operation by causing the new fluid distribution pattern to sweep oil from those areas of the formation which are least effected by the original fluid distribution pattern.

Numerous other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
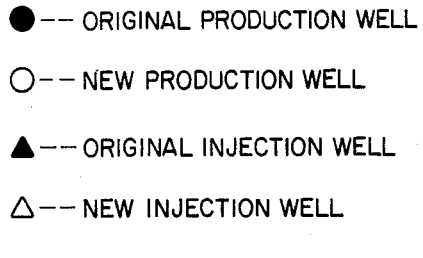
FIG. 1 illustrates and defines the symbols used in the other figures to identify the various wells involved in the patterns.

FIG. 1 illustrates and defines the symbols used in the remaining figures to represent the various wells shown in the patterns.

The terminology used throughout this description will refer to original wells and new wells. Original wells are those wells which are associated with an original fluid distribution pattern such as a five-spot or nine-spot pattern. New wells refer to wells which are subsequently provided to modify the original fluid distribution pattern to change it to the seven-spot patterns of the present invention.

Figure 4:
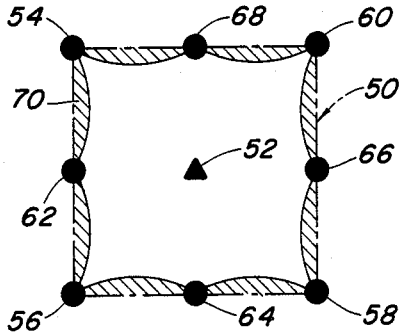
Fig. 4 (PRIOR ART)
FIG. 4 illustrates a typical prior art nine-spot pattern.

Reference to a well as a new well, however, does not necessarily require that the new well have been newly drilled. Although in most instances regarding five-spot patterns, the new wells will be wells that have been newly drilled subsequent to the original stage of flooding, that is not necessarily the case. The term "new well" is intended to cover either a newly drilled well or an existing well which has previously been shut in or which has previously served another function other than that required by the new well. For example, as will be further explained below, if the original fluid distribution pattern is a nine-spot pattern as illustrated in FIG. 4, the original side production wells can in some cases be converted into injection wells and thus become new injection wells within the context and terminology of the present invention.

As illustrated in FIG. 1, a solid circle represents an original production well. An empty circle represents a new production well. A solid triangle represents an original injection well. An empty triangle represents a new injection well.

Figure 2:
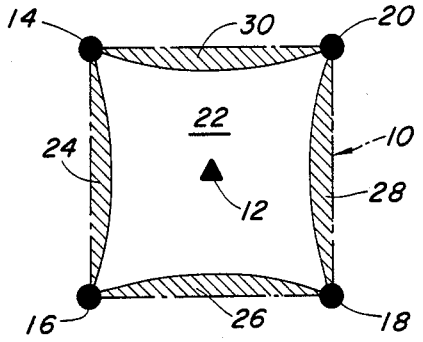
Fig. 2 (PRIOR ART)
FIG. 2 illustrates a typical prior art five-spot pattern having a central injection well and four corner production wells.

FIG. 2 schematically illustrates a typical prior art flooding pattern which is commonly referred to as an inverted five-spot pattern. The inverted five-spot pattern shown in FIG. 2 is represented by the square phantom outline designated by the numeral 10.

The five-spot pattern 10 includes an original central injection well 12 and four original corner production wells 14, 16, 18 and 20, all of which intersect a common subsurface oil-bearing formation.

In the initial flooding operation utilizing such a five-spot pattern 10, the driving fluid such as steam or water is injected into the original central injection well 12 and will flow to the four original corner production wells 14, 16, 18 and 20. This tends to create a central area 22 within the five-spot pattern 10 which is relatively effectively swept by the driving fluid so that the oil originally in place therein is produced from the various original production wells. Also typically, there will be relatively unaffected areas which are schematically illustrated as shaded areas 24, 26, 28 and 30 in FIG. 2.

It will be understood that the representation of the central area 22 and the relatively unaffected areas 24, 26, 28 and 30 in FIG. 2 is only very schematic. In any real situation, the flow of injected fluid from original central injection well 12 to the various corner production wells will generally not be uniform, and the shape of the unaffected areas 24, 26, 28 and 30 will not be nearly so regular as the areas shown in FIG. 2.

FIG. 2 does not illustrate the condition of those areas of the formtion outside the boundaries of the five-spot pattern 10. If the five-spot pattern 10 is merely one such pattern unit within a field made up of similar pattern units, then the relatively unaffected areas 24, 26, 28 and 30 will also extend outside the boundaries of the five-spot pattern unit 10 and will be shaped more as represented schematically in FIG. 3.

Figure 3:
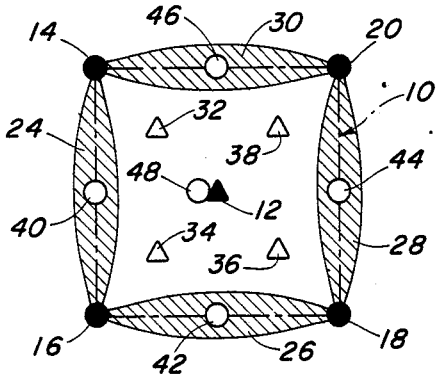
Fig. 3 (PRIOR ART)
FIG. 3 illustrates a typical prior art technique for modifying a five-spot pattern such as shown in FIG. 2 to create four smaller five-spot patterns.

FIG. 3 represents the typical prior art technique for modifying an original five-spot pattern unit such as the pattern unit 10 shown in FIG. 2 to create four smaller five-spot pattern units.

In this prior art technique, four new injection wells 32, 34, 36 and 38 are provided at points aligned substantially midway between the original central injection well 12 and the four original corner production wells 14, 16, 18 and 20, respectively.

Additionally, four new production wells 40, 42, 44 and 46 are provided at positions aligned and substantially midway between each two adjacent ones of the original corner production wells.

Also, typically a fifth new production well 48 is provided immediately adjacent the location of the original central injection well.

Thus, four new smaller five-spot pattern units are provided. For example, one of these new smaller five-spot pattern units is defined by new injection well 32 at the center thereof, which is surrounded by original corner production well 14, and new production wells 40, 48 and 46 to define the new smaller five-spot pattern.

The problem which is encountered when using the system illustrated in FIG. 3 is that when driving fluid such as steam or water is injected into the new injection well such as 32, it will tend to channel directly to original corner production well 14 and the centrally located new production well 48 because the areas of the formation in those directions has already been swept of much of its oil providing paths of low resistance to fluid flow. Thus, much of the injected fluid will tend to flow through areas which have already been swept of oil and to the original corner production well 14 and new production well 48, rather than flowing through the relatively unaffected areas 24 and 30 toward the new production wells 40 and 46.

It is this problem which the methods of the present invention seek to overcome.

FIG. 4 schematically illustrates a typical prior art nine-spot pattern unit 50. The nine-spot pattern unit 50 includes an original central injection well 52, four original corner production wells 54, 56, 58 and 60, and four original side production wells 62, 64, 66 and 68.

Also schematically illustrated in FIG. 4 are the shape of relatively unaffected areas such as 70 which tend to not be swept by the original nine-spot fluid distribution pattern.

Figure 5:
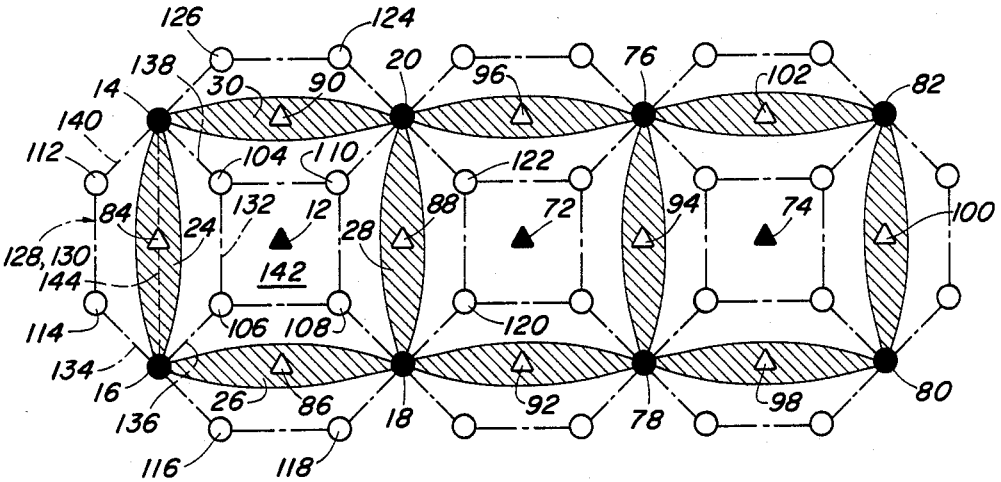
FIG. 5 illustrates the methods of the present invention whereby one or more original five-spot patterns are modified to create a plurality of seven-spot pattern units.

Referring now to FIG. 5, the new infill drilling pattern of the present invention and the related methods of modifying an original fluid distribution pattern will be described.

In FIG. 5, the five original wells 12, 14, 16, 18 and 20 of the five-spot pattern 10 of FIG. 2 have been illustrated on the left side of FIG. 5. Also shown are two additional contiguous five-spot patterns which are defined by additional original central injection wells 72 and 74 and additional original corner production wells 76, 78, 80 and 82.

As can be seen in FIG. 5, each of the original central injection wells 12, 72 and 74 is in the center of an original five-spot pattern unit, the perimeters of which are defined by four of the original corner production wells.

The present invention provides a method of modifying this original fluid distribution pattern such as that made up by the original central injection wells and original corner production wells shown in FIG. 5 into a new pattern comprised of a plurality of contiguous seven-spot pattern units of smaller area than the original five-spot pattern units. These new seven-spot pattern units are oriented so as to efficiently sweep those areas such as 24, 26, 28 and 30 which were relatively unaffected by the original five-spot distribution pattern.

By the methods of the present invention, a plurality of new injection wells 84, 86, 88, 90, 92, 94, 96, 98, 100 and 102 are provided in approximately aligned positions midway between adjacent ones of the original corner production wells.

This places each of the new injection wells in the center of one of the areas of the formation which was previously relatively unaffected by the original five-spot distribution pattern. For example, new injection well 84 is located in the center of area 24.

Additionally, by the methods of the present invention, a plurality of new production wells is provided at locations in approximately aligned positions midway between one of the original central injection wells and an associated one of the original corner production wells.

For ease of description, only the new production wells associated with the leftmost original five-spot pattern surrounding original central injection well 12 will be numbered and described in detail. As is apparent in FIG. 5, the new production wells associated with the original five-spot pattern surrounding original central injection wells 72 and 74 are similarly positioned.

There are four new production wells 104, 106, 108 and 110 located at positions between original central injection well 12 and original corner production wells 14, 16, 18 and 20, respectively.

Additionally, there are eight other new production wells which are associated with the new seven-spot patterns which are partly defined within the original five-spot pattern surrounding original central injection well 12. These new production wells have been designated by the numerals 112, 114, 116, 118, 120, 122, 124 and 126.

As is apparent from FIG. 5, these other new production wells 112 through 126 may be associated with contiguous five-spot patterns, such as seen for example with wells 120 and 122, or they may lie outside any existing five-spot pattern but be in positions analogous to those which would be present if there were a contiguous five-spot pattern.

These new injection wells and new production wells as illustrated in FIG. 5 are so arranged that each of the new injection wells is surrounded by two adjacent ones of the original corner production wells and four of the new production wells thus defining a new seven-spot pattern unit.

For example, new injection well 84 is surrounded by original corner production wells 14 and 16 and new production wells 104, 106, 112 and 114, thus defining a new seven-spot pattern unit which is shown in phantom lines and designated by the numeral 128. Nine other similar unnumbered seven-spot patterns are shown in FIG. 5 in phantom lines.

Steam or water or other driving fluid is injected into the new injection well 84 and sweeps through the area 24 toward the six surrounding production wells to drive oil remaining in the relatively unaffected area 24 to those production wells.

As previously mentioned, each of the new injection wells such as 84 is preferably located in a substantially aligned position substantially midway between adjacent original corner production wells such as 14 and 16. It will be appreciated, however, that the invention does not require that the new injection wells be located exactly in an aligned position or exactly in a midway position.

Similarly, the new production wells such as 104 are preferably located in a substantially aligned position substantially midway between one of the original central injection wells such as 12 and an original corner production well such as 14. Again, however, the invention does not require that the new production wells be in an exactly aligned or an exactly midway position. Further, with regard to the new production wells, it is conceivable that in some situations it might be desirable to place them at locations other than a midway position. For example, in some situations it might be desirable to move the new production wells closer to their associated original central injection well so as to make the distances between the new injection wells such as 84 and all six of its surrounding associated production wells more nearly equal. As will be appreciated in viewing FIG. 5, the new production wells 104, 106, 112 and 114 will always be located closer to the new injection well 84 than will the original corner production wells 14 and 16, assuming that the new injection 84 is located substantially midway between the original corner production wells 14 and 16.

As is apparent in viewing the new seven-spot pattern unit 128 illustrated in phantom lines in the left-hand portion of FIG. 5, that pattern unit defines a hexagon having two parallel longer sides 130 and 132 of substantially equal length each extending between two of the new production wells. The hexagon defining the boundaries of seven-spot pattern 128 also includes four shorter sides 134, 136, 138 and 140 of substantially equal lengths each extending from an end of one of the longer sides 130 and 132 to one of the original corner production wells 14 and 16.

The overall new pattern as seen in FIG. 5 is made up of a plurality of contiguous seven-spot patterns, such as pattern 128, which are arranged such that each of the original central injection wells such as 12 is in the center of an excluded square area, such as the area 142 defined by new production wells 104, 106, 108 and 110. This excluded square area 142 is surrounded by but not included in four contiguous ones of the new seven-spot pattern units.

For example, the excluded square area 142 is surrounded by four contiguous new seven-spot patterns associated with the four new injection wells 84, 86, 88 and 90.

To break down the new infill drilling pattern of the present invention to its smallest component, the new seven-spot pattern 128 can be described with relation to a single original five-spot pattern such as the pattern 10 defined by original corner production wells 14, 16, 18 and 20.

To form one of the new seven-spot patterns such as 128, at least one new injection well such as 84 is located substantially along an imaginary straight line between adjacent ones of the original corner production wells such as 14 and 16. This imaginary line is shown as a dashed line in FIG. 5 and is designated by the numeral 144.

Additionally, at least four new production wells are provided, which are associated with this new injection well 84.

A first pair of these new production wells, namely new production wells 104 and 106 are provided at locations substantially aligned between the original central injection well 12 and the adjacent corner production wells 14 and 16, respectively. New production wells 104 and 106 are located at substantially equal distances from the original central injection well 12, and preferably are located substantially midway between original central injection well 12 and original corner production wells 14 and 16.

A second pair of new production wells, namely new production wells 112 and 114 are located substantially as a mirror image of the first pair of production wells, namely 104 and 106, respectively, about the imaginary straight line 144.

When the new production wells such as 104 and 106 are located midway between the original central injection well 12 and the original corner production wells 14 and 16, respectively, the new seven-spot pattern 128 covers an area equal to approximately 37.5 percent of the area covered by the original five-spot pattern 10 defined within the original corner production wells 14, 16, 18 and 20. Thus, if the original five-spot pattern 10 covers a square area of twenty acres, the new seven-spot pattern 128 will cover an area of seven and one-half acres. Additionally, the excluded square area 142 defined within new production wells 104, 106, 108 and 110 will have an area of five acres.

Also, as is readily apparent from reviewing the geometry of the pattern illustrated in FIG. 5, the shorter sides such as 134 and 136 of seven-spot pattern 128 will intersect at original corner production well 16 at an angle of 90°. Similarly, shorter sides 138 and 140 intersect at original corner production well 14 at an angle of 90°. Each of the shorter sides 134, 136, 138 and 140 intersects one of the longer sides 130 and 132 at an angle of 135°.

Additionally, the longer sides 130 and 132 of new seven-spot pattern 128 have a length equal to one-half the distance between an adjacent pair of original corner production wells such as 14 and 16. Each of the shorter sides 134, 136, 138 and 140 will have a length equal to the square root of 2 divided by 2 (approximately 0.707) times the length of one of the longer sides 130 or 132.

The seven-spot pattern 128 is substantially symmetrical about imaginary straight line 144, and all four of the new production wells 104, 106, 112 and 114 associated with new injection well 84 are at equal distances from the imaginary straight line 144.

When using the modified pattern including the contiguous seven-spot pattern units as illustrated in FIG. 5, the original central injection wells 12, 72 and 74 will be shut in unless they are needed as back-up injection wells. If necessary, however, driving fluid may continue to be injected into one or more of the original central injection wells 12, 72 or 74 so as to confine the fluids injected into the new injection wells to the areas within the boundaries of the new seven-spot patterns.

If the field under consideration is initially covered by a pattern made up solely of contiguous five-spot pattern units such as the five-spot pattern unit 10 shown in FIG. 2, then all of the new injection wells and new production wells shown in FIG. 5 will be newly drilled for the purpose of creating the new seven-spot pattern units illustrated in FIG. 5.

If, however, the field is originally flooded utilizing a pattern consisting of contiguous nine-spot pattern units such as the nine-spot pattern unit 50 shown in FIG. 4, then it will be apparent that the new injection wells illustrated in FIG. 5 may be provided by converting the original side production wells such as 62, 64, 66 and 68 of the nine-spot pattern unit 50 seen in FIG. 4 into new injection wells such as 84, 86, 88 and 90 illustrated in FIG. 5.

In any instance where there is an original well in substantially the same location that one of the new injection wells or new production wells is required to be provided in FIG. 5, it is within the scope of the present invention if that original well is converted from its original purpose to function as required by the pattern illustrated in FIG. 5. In some cases, of course, even if there is an original well at approximately the correct location, it may be that it is not capable of being converted to the desired function. For example, if the pattern illustrated in FIG. 5 is being utilized in a steam flood project, and if the original well which is located at the position where a new well is desired was not constructed to withstand the heat encountered during steam injection, then it may be necessary to drill and provide a new well at approximately that same location even though an existing well is already there.

It will be appreciated in viewing FIG. 5, that each of the original five-spot patterns is in effect converted to two effective smaller seven-spot patterns and a smaller five-spot pattern. Actually, each original five-spot pattern is converted into four halves of the new seven-spot patterns and the central five-spot pattern such as represented by the excluded square area 142.

When utilizing the new seven-spot patterns as illustrated in FIG. 5, and assuming that the original central injection wells such as 12, 72 and 74 are shut in, the effective ratio of producing wells to injection wells is raised to 2:1. This is a significant improvement over the original five-spot pattern such as illustrated in FIG. 2 wherein the ratio of injection wells to production wells is 1:1. This significantly improves the capture efficiency of the overall pattern since there are significantly more producing wells available to capture oil driven away from each of the active injection wells.

Also, it will be appreciated for any given overall pattern, such as the pattern shown in FIG. 5 consisting of three contiguous original five-spot patterns, that the outer fringes of the overall pattern may need to be confined in some way to prevent injection fluids from escaping the overall pattern. This outer confinement is typically accomplished through the use of additional back-up injection wells surrounding the pattern or sometimes by natural formation boundaries as will be understood by those skilled in the art.

Thus it is seen that the methods of the present invention readily achieve the ends and advantages mentioned as well as those inherent therein. While certain preferred embodiments of the present invention have been illustrated and described for the purposes of the present disclosure, numerous changes in the arrangement and exact manner of performance of the various steps may be made by those skilled in the art, which changes are encompassed within the scope and spirit of the invention as defined by the appended claims.

What is claimed is:

1. A method of modifying an original fluid distribution pattern for injecting driving fluid into a subsurface formation, said original pattern including a plurality of contiguous original pattern units each including an original central injection well and four original corner production wells substantially defining the corners of an imaginary square, contiguous ones of said original pattern units sharing two common ones of said original corner production wells, said method comprising the steps of:

(a) providing a plurality of new injection wells each being located in an approximately aligned position between adjacent ones of said original corner production wells;

(b) providing a plurality of new production wells each being located in an approximately aligned position between one of said original central injection wells and an associated one of said original corner production wells, said new injection wells and new production wells being so arranged that each of said new injection wells is surrounded by two adjacent ones of said original corner production wells and four of said new production wells thus defining a new seven-spot pattern unit; and (c) injecting said driving fluid into said new injection wells to sweep relatively high oil saturation areas of said formation that remain after initial flooding of said formation by said original fluid distribution pattern.

2. The method of claim 1, further comprising the step of:

shutting in at least some of said original central injection wells.

3. The method of claim 1, wherein:

said new injection wells are provided at points substantially midway between adjacent ones of said original corner production wells.

4. The method of claim 3, wherein:

said new production wells are each located substantially midway between said one of said original central injection wells and said associated one of said original corner production wells, so that each of said new seven-spot pattern units is substantially identical and defines a hexagon having two parallel longer sides of substantially equal length each extending between two of said new production wells and having four shorter sides of substantially equal length each extending from an end of one of said longer sides to one of said original corner production wells, thus defining a new fluid distribution pattern made up of a plurality of contiguous seven-spot patterns arranged such that each of said original central injection wells is in a center of an excluded square area which is surrounded by but not included in four contiguous ones of said new seven-spot pattern units.

5. The method of claim 1, wherein:

said new production wells are each located substantially midway between said one of said original central injection wells, and said associated one of said original corner production wells.

6. The method of claim 1, further comprising the step of:

producing oil swept by said driving fluid through said new production wells and said original corner production wells.

7. The method of claim 1, further comprising the step of:

using at least some of said original central injection wells as back-up injection wells to aid in confining flow of said driving fluid within said new seven-spot pattern units.

8. The method of claim 1, wherein:

said driving fluid includes primarily water.

9. The method of claim 1, wherein:

said driving fluid includes primarily steam.

10. The method of claim 1, wherein:

said original pattern units are five-spot pattern units.

11. The method of claim 10, wherein:

said step (a) is further characterized in that at least some of said new injection wells are newly drilled for the purpose of creating said new seven-spot pattern units.

12. The method of claim 1, wherein:

said original pattern units are nine-spot pattern units which also each include four original side production wells, each of said side production wells being located in a substantially aligned configuration substantially midway between adjacent ones of said original corner production wells.

13. The method of claim 12, wherein:

said step (a) is further characterized in that at least some of said new injection wells are provided by converting at least some of said original side production wells into said new injection wells.

14. A method of modifying an original fluid distribution pattern for injecting driving fluid into a subsurface formation, said original pattern including an original central injection well and four original corner production wells substantially defining the corners of an imaginary square, said method comprising the steps of:

(a) providing at least one new injection well located substantially along an imaginary straight line between adjacent ones of said original corner production wells;

(b) providing at least four new production wells, a first pair of said new production wells being provided at loctions substantially aligned between said original central injection well and said adjacent ones of said original corner production wells at substantially equal distances from said original central injection well, and a second pair of said new production wells being located substantially as a mirror image of said first pair about said imaginary straight line;

(c) thereby providing at least one new seven-spot pattern having said one new injection well located therein, said one new injection well being surrounded by said adjacent ones of said original corner production wells and said first and second pairs of new production wells; and (d) injecting said driving fluid into said one new injection well and thereby driving oil to at least some of said adjacent ones of said original corner production wells and said first and second pairs of new production wells.

15. The method of claim 14, wherein:

said original pattern is a five-spot pattern.

16. The method of claim 15, wherein:

said new injection well is newly drilled for the purpose of creating said new seven-spot pattern.

17. The method of claim 15, wherein:

said locations of said first pair of said new production wells are substantially midway between said original central injection well and said adjacent ones of said original corner production wells, so that said new seven-spot pattern covers an area equal to approximately 37.5% of an area covered by said original pattern.

18. The method of claim 17, wherein:

said step (a) is further characterized as providing at least four such new injection wells; and said step (b) is further characterized as providing at least twelve new production wells to provide four contiguous seven-spot patterns surrounding but not including said original central injection well.

19. The method of claim 17, wherein:

said new injection well is located substantially midway between said adjacent ones of said original corner production wells.

20. The method of claim 15, wherein:

said new injection well is located substantially midway between said adjacent ones of said original corner production wells.

21. The method of claim 15, further comprising the step of:

shutting in said original central injection well.

22. The method of claim 15, further comprising the step of:

using said original central injection well as a back-up injection well to aid in confining flow of said driving fluid within said new seven-spot pattern.

23. The method of claim 15, wherein:

said driving fluid includes primarily water.

24. The method of claim 15, wherein:

said driving fluid includes primarily steam.

25. The method of claim 14, wherein:

said original pattern is a nine-spot pattern which also includes four original side production wells.

26. The method of claim 25, wherein:

said step (a) is further characterized in that said new injection well is provided by converting one of said original side production wells into said new injection well.

27. A method of modifying an original five-spot distribution pattern including an original central injection well and four original corner production wells, all of said wells intersecting a common subsurface formation, said method comprising the steps of:

(a) providing a new injection well in an approximately aligned position between adjacent ones of said original corner production wells;

(b) injecting driving fluid into said new injection well;

(c) producing formation fluids from said adjacent ones of said original corner production wells; and (d) wherein said driving fluid sweeps from said new injection well toward said adjacent ones of said original corner production wells thereby sweeping formation fluid from areas of said formation which were relatively unaffected by said original five-spot distribution pattern.

28. The method of claim 27, further characterized in that there is a plurality of contiguous original five-spot distribution patterns, wherein:

said step (a) is further characterized in that up to four of said new injection wells are associated with each original five-spot distribution pattern;

said method further includes a step of providing up to four new production wells associated with each of said original five-spot distribution patterns, each of said new production wells being located in an approximately aligned position between the original central injection well and one of the original corner production wells of its associated original five-spot distribution pattern; and said new injection wells and said new production wells are arranged to form a new distribution pattern made up of a plurality of contiguous non-equilateral seven-spot patterns.

29. The method of claim 27, further comprising the step of:

providing four new production wells associated with said new injection well, thus forming a new seven-spot pattern including said new injection well, said adjacent ones of said original corner production wells, and said four new production wells.

30. The method of claim 29, wherein:

said new seven-spot pattern is substantially symmetrical about an imaginary straight line between said adjacent ones of said original corner production wells; and said new production wells are all at equal distances from said imaginary line.

31. The method of claim 30, wherein:

two of said new production wells are located substantially midway in aligned positions between said original central injection well and said adjacent ones of said corner production wells.

32. The method of claim 31, wherein:

said new injection well is substantially midway between said adjacent ones of said original corner production wells.

* * * * *